United States Patent [19]

Bowling

[11] 4,263,720

[45] Apr. 28, 1981

[54] SYSTEM AND METHOD FOR MONITORING AIR FLOW IN A BULK TOBACCO CURING AND DRYING STRUCTURE

[76] Inventor: James T. Bowling, 2112 Hwy. 70, Garner, N.C. 27529

[21] Appl. No.: 85,750

[22] Filed: Oct. 17, 1979

[51] Int. Cl.[3] ..... F26B 3/06

[52] U.S. Cl. ..... 34/22; 34/89; 34/225; 432/500; 131/302; 165/11 R

[58] Field of Search ..... 34/89, 219, 224, 225, 34/30, 34, 54, 22; 62/127; 165/11; 432/500; 131/140

[56] References Cited

U.S. PATENT DOCUMENTS

| | | | |
|---|---|---|---|
| 2,779,305 | 1/1957 | Dunkelman | 34/89 |
| 3,217,424 | 11/1965 | Johnson et al. | 34/89 |
| 4,123,221 | 10/1978 | Danford | 432/500 |

*Primary Examiner*—Larry I. Schwartz
*Attorney, Agent, or Firm*—Mills & Coats

[57] ABSTRACT

The present invention relates to a system and method of monitoring air flow in a bulk tobacco curing and drying structure wherein the system and method is designed to actuate an alarm device in response to the air flow within the bulk tobacco curing and drying structure falling below a preset level. In particular, the system and method entails providing an air flow monitoring device in the path of a system of air that is circulated vertically through the mass of bulk tobacco contained within the curing and drying structure. The air flow monitoring device is operatively associated with a master "on-off" switch and is operatively connected to a main control panel or unit that is in turn operatively associated and connected to an alarm device such as a siren. One air flow within the bulk curing and drying structure ceases or falls below a preselected value, the air flow monitoring device is operative to actuate a relay within the main control unit which in turn actuates a switch that closes a circuit having said alarm device included therein, causing the alarm device to be actuated and accordingly appraise an individual in the vicinity of the bulk curing and drying structure of the fact that the air flow within the bulk curing structure has falling below the preselected value.

6 Claims, 2 Drawing Figures

SYSTEM AND METHOD FOR MONITORING AIR FLOW IN A BULK TOBACCO CURING AND DRYING STRUCTURE

The present invention relates to bulk tobacco curing and drying structures, and more particularly to a bulk tobacco curing and drying structure provided with air flow monitoring means for continuously monitoring air flow therein and operative to actuate an alarm device for emitting a discernible signal indicating that air flow has ceased within the structure or that it is below an acceptable level.

BACKGROUND OF INVENTION

Since the early 70's, flue cured tobacco farmers have turned to bulk tobacco curing since it requires less labor and is generally more efficient than conventional stick curing. In bulk curing, the tobacco leaf material is packed in bulk and oriented within the curing and drying structure in such a manner that air can be circulated vertically through the mass of tobacco leaves. Typically, a forced air furnace system is utilized that acts to generate a system of air and continuously circulate the air through the tobacco. A curing and drying schedule is maintained during the curing and drying process and in so maintaining such a schedule it is necessary to add heat from time to time to the system of circulating air. This is typically accomplished by a furnace system such as an oil or gas fired furnace.

As mentioned above, the system of air is continuously circulated and generally this is accomplished by an electrically driven fan that may generally range between five and ten horsepower. Typically the curing and drying process will last approximately six to seven days and throughout this curing the fan is run continuously.

It is in this area of the air flow control that many problems have been experienced in bulk tobacco curing and drying structures. One such problem is where the electric motor driving the fan fails or where electricity to the motor is inadvertently interrupted. The ceasing of air flow within the structure results in the tobacco being severely damaged and inappropriate for marketing. This is especially a problem in bulk curing because the tobacco is tightly packed together and once air flow is stopped, the tobacco leaf material finds itself surrounded by warm or hot pockets of moisture and if this state is allowed to stand for an even small amount of time, the tobacco leaf material will rot and severe damage will be imparted to the tobacco crop material within the drying structure.

Therefore, there is a real need for the farmer to be appraised of the fact that air flow within a bulk tobacco curing and drying structure has ceased or falls below a preselected value in order that the farmer can take steps to rectify the problem and save the tobacco crop material from rotting or being damaged.

SUMMARY OF INVENTION

The present invention entails a system and method of monitoring air flow within a bulk barn or bulk tobacco curing and drying structure and for emitting a discernible alarm signal in response to the air flow within the bulk barn ceasing or falling below a selected level. The emitted signal will be heard by an individual in the vicinity of the bulk barn and upon hearing the same, the individual can take appropriate steps to rectify the problem and restore air flow to a normal flow rate.

More particularly, the present invention comprises an air flow monitoring device positioned in the path of air flow within the curing and drying structure. The air flow monitoring device is adapted to actuate a control unit in response to air flow within the curing and drying structure reaching an insufficient or preselected level. Once actuated, the control unit is operative to close an electrical circuit having an alarm device electrically connected therein so as to actuate the same.

It is, therefore, an object of the present invention to provide a system and method for monitoring air flow in a bulk tobacco curing and drying structure and for actuating an associated alarm device in response to air flow ceasing or falling below a selected value.

A further object of the present invention resides in the provision of a system and method for monitoring air flow that will eliminate damages and losses in tobacco due to the absence of sufficient air flow during the curing and drying process within a bulk tobacco barn.

A further object of the present invention is to provide a system and method of monitoring air flow within a bulk tobacco barn which will actuate a siren device once the air flow therein during the curing and drying process ceases or falls below a threshold or selected value, whereby the actuation of the siren device will appraise individuals within the vicinity of the problem of insufficient air flow in order that the same may be rectified quickly.

Still a further object of the present invention resides in the provision of an air flow monitoring system for a bulk barn of the character described above which is adapted to be efficiently utilized by a group of bulk barns by providing one single control unit that is operatively connected to an air monitoring device associated with each of the bulk barns, whereby the control unit may be actuated by any one air flow monitoring device and upon actuation the control unit is operative to actuate the alarm device for appraising one in the vicinity of the inadequate air flow within a certain bulk barn.

Another object of the present invention risides in the provision of a system for monitoring air flow within a bulk tobacco barn that is simple, relatively inexpensive, effective, reliable and easy to install within an existing bulk barn.

Other objects and advantages of the present invention will become apparent from a study of the following description and the accompanying drawings which are merely illustrative of the present invention.

DESCRIPTION OF PREFERRED EMBODIMENT

Figure 1:
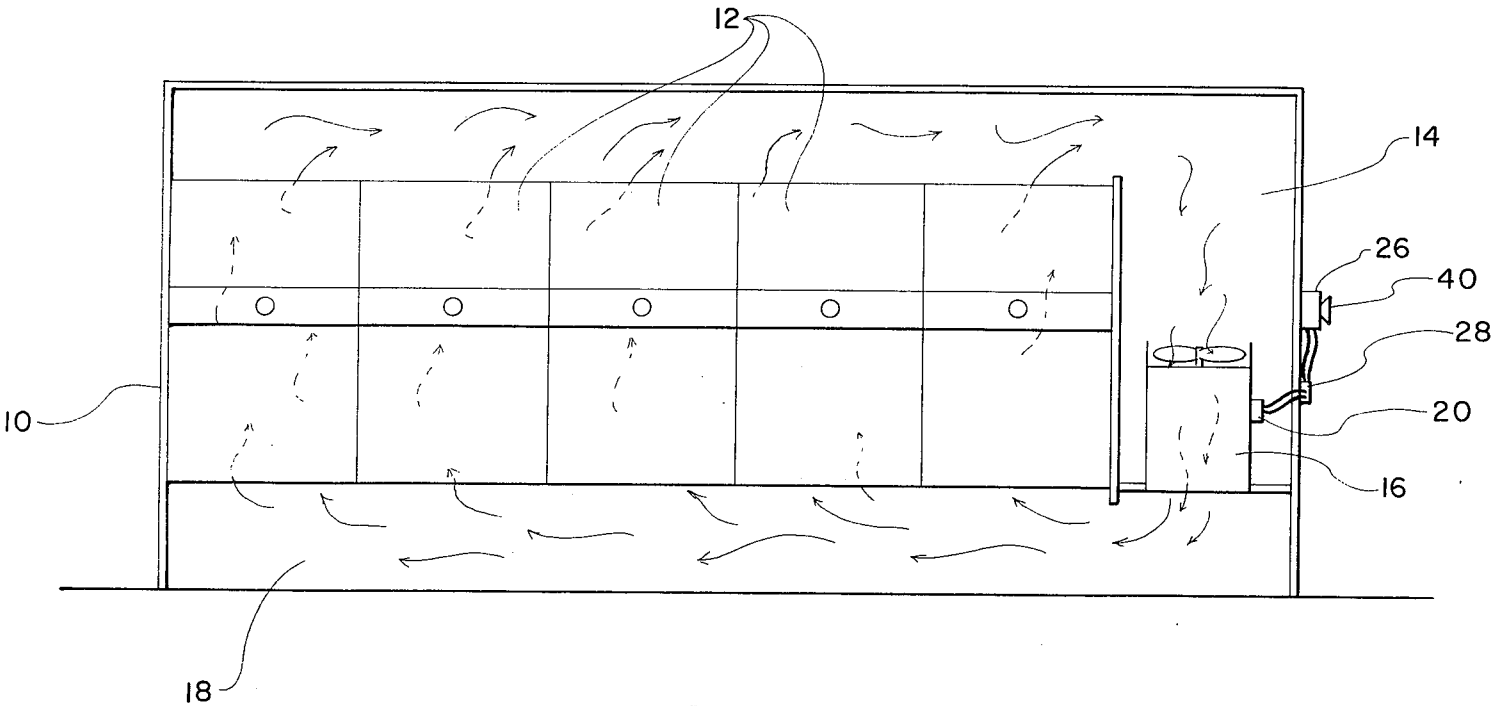
FIG. 1 is a cross sectional view of the bulk tobacco barn illustrating the basic air flow path therethrough.

With further reference to the drawings, particularly FIG. 1, the system for monitoring air flow in a bulk tobacco curing and drying structure is schematically shown therein. Before discussing the actual air flow monitoring circuit and the included components therein, it might be beneficial to briefly review the structure of a bulk barn which is indicated generally by the numeral 10 in FIG. 1.

Generally viewing bulk barn 10 it is seen that the same includes a series of rack means 12 that is supported within the barn 10 and adapted to contain bulk tobacco material therein. For a complete and unified understanding of various types of bulk tobacco racks, one is referred to the disclosures found in U.S. Pat. Nos. 3,105,713 and 3,948,553, these disclosures being expressly incorporated herein by reference.

Continuing to refer to bulk barn 10, it is seen that the same includes a rear furnace room 14 that includes a furnace system 16 therein that is adapted to circulate air and to heat the air as necessary to maintain a selected temperature level within the bulk barn 10. In circulating the air, the furnace system 16 is adapted, in the type of design shown in FIG. 1, to force air downwardly into a plenum area 16 from which the air is forced upwardly through the tobacco contained within the rack means 12. After exiting the rack means, the air is continuously circulated back to the furnace system 16. As appreciated by those skilled in the art, the barn 10 would be provided with means to exhaust certain portions of circulating air and to allow fresh inlet air to enter the system.

Thus, during the curing and drying process, the air is continuously circulated vertically through the mass of bulk tobacco contained within the rack means 12. As already eluded to herein, it is quite important and even critical that air flow be continuously maintained during the entire curing and drying process because without continuous air flow through the tobacco material the crop can be severely damaged and the resulting crop loss can be substantial.

Accordingly, the present invention addresses itself to continuously monitoring air flow within the bulk barn 10 and is adapted to warn or signal the absence of air flow within the bulk barn or even the fact that the air flow has dropped below a preselected value.

Figure 2:
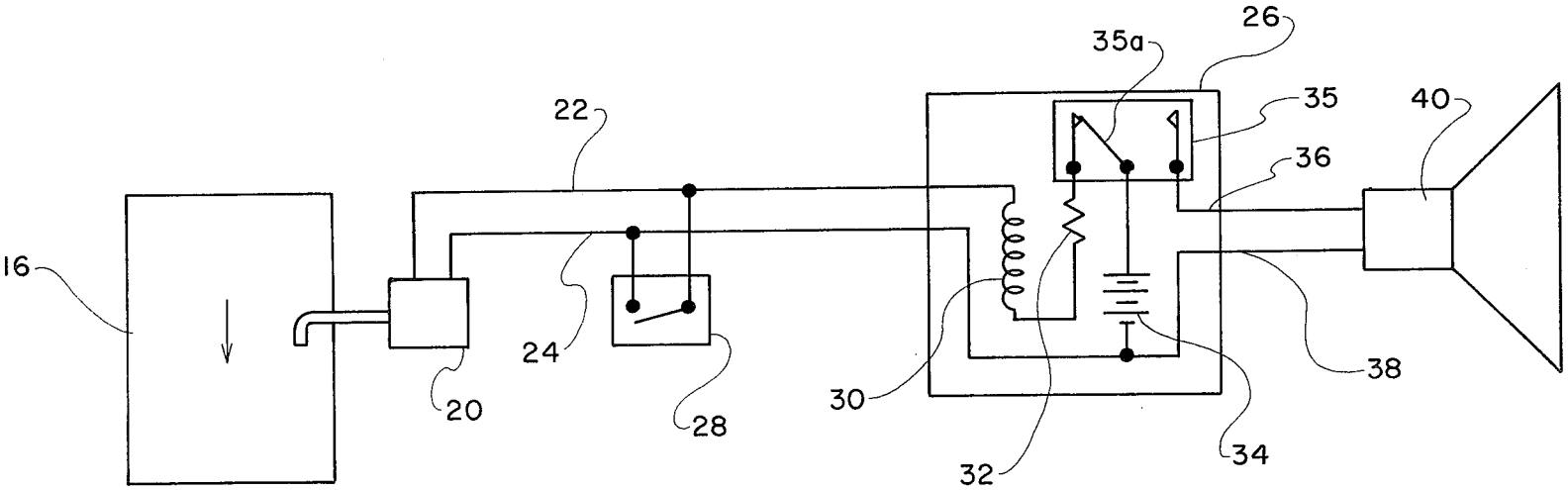
FIG. 2 is a schematic illustration of the system for monitoring air flow within a bulk tobacco curing and drying structure.

In this regard, the present invention includes an air flow monitoring device 20 that is positioned within the air flow path within the bulk tobacco barn and which is adapted to sense air flow and to respond when the air flow ceases or falls below a preselected value. This air flow monitoring device is illustrated in FIG. 2 and indicated by numeral 20. Details of the air flow monitoring device itself is not dealt with herein because such is known in the prior art and is not material per se to the present invention.

Leading from the air flow monitoring device is a pair of electrical connecting lines 22 and 24 that lead to a control unit or panel indicated generally by the numeral 26. Lines 22 and 24 form a part of what is referred to as the air flow monitoring circuit and includes within the control panel or unit 26 a relay 30 and a resistor 32. Completing the air flow monitoring circuit is a switch assembly 35 including a switch 35*a* and a DC power source 34.

Connected in parallel with the air flow monitoring device 20 is a master on-off control switch 28. When the air flow monitoring device 20 is in an operative state, the master switch 28 will assume an off position. When the air flow monitoring device is inoperative, the master switch 28 will be in an "on" position.

Operatively connected and associated with the control panel or unit 26 is an alarm circuit that as illustrated in the drawings includes lines 36 and 38 that are operatively connected to the switch assembly 35 and to an opposite point of the air flow monitoring circuit adjacent battery 34. Lines 36 and 38 lead to an alarm device in the form of a siren 40. It is thusly appreciated that when switch 35*a* is in the leftmost position as viewed in FIG. 2 that the alarm circuit is open and that the air flow monitoring circuit is closed and operative to conduct current therethrough. In the rightmost position, switch 35 closes the alarm circuit and the siren would be actuated due to the current flowing from battery 34.

In a normal state of operation where the air flow monitoring device 20 would be operative, the master switch 28 would be in an off position and switch 35*a* would be closed to the air flow monitoring circuit such that current from battery 34 would be moving through lines 22 and 24. As long as air was flowing in the bulk barn 10, the air flow monitoring circuit would be closed and the alarm circuit would be open. Once air flow ceases because of a failure in the furnace system 16 or a disruption of electricity to the furnace system, or even where the air flow falls below a preselected value, the air flow monitoring device would sense this and in sensing such would cease to conduct current therethrough. This would effectively open the air flow monitoring circuit. This would trigger relay 30 which in turn would drive switch 35*a* from its leftmost position to its rightmost position causing the alarm circuit or siren circuit to be closed, resulting in the alarm device or siren sounding. Consequently, the signal emitted by the alarm device would be discerned by individuals in the area and then steps could be taken to rectify the problem with the air flow within the bulk barn.

It is appreciated that in many farming installations, the farmer would have a series of bulk barns disposed in one general vicinity. In such an instant, one control panel or unit 26 would serve all of the barns by providing an air flow monitoring circuit from each of the barns, with each air flow monitoring circuit being directed to one central control unit or panel 26 and each circuit being operative to independently actuate the control panel 26.

Therefore, it is seen that the present invention presents a simple and dependable system and method of continuously monitoring air flow in a bulk tobacco curing and drying structure. In addition, the system is easily adapted to existing bulk barns and has great utility inasmuch as the same can be effective to prohibit crop damage during the curing and drying process due to air flow failure or the fact that air flow falls below a preselected value.

The present invention, of course, may be carried out in other specific ways than those herein set forth without departing from the spirit and essential characteristics of the invention. The present embodiments are, therefore, to be considered in all respects as illustrative and not restrictive and all changes coming within the meaning and equivalency range of the appended Claims are intended to be embraced therein.

What is claimed is:

1. A method of bulk curing and drying tobacco and monitoring air flow through a bulk tobacco barn housing the tobacco therein during the curing and drying process, the method comprising the steps of: circulating a system of air vertically through a mass of tobacco disposed within said bulk barn; heating the air as necessary to maintain a selected temperature level within said bulk barn; positioning an air flow monitoring device within the path of air being circulated through said bulk barn; switching an air flow monitoring system to an "on" state; sensing the air flow of the system as air is directed through the bulk barn and vertically through the tobacco contained therein; actuating said air flow monitoring device in response to the air flow within said bulk barn falling below a selected level; actuating a control unit in response to said air flow monitoring device being actuated; and actuating an alarm device in response to said control unit being actuated and thusly appraising individuals in the vicinity of the bulk barn that the air flow has fallen below said selected level.

2. The method of bulk tobacco curing and drying and monitoring air flow within a bulk tobacco barn, as recited in claim 1, wherein the step of actuating an alarm device includes the step of emitting an audible siren alarm sound.

3. The method of bulk tobacco curing and drying and monitoring air flow of claim 2 wherein the method entails monitoring a series of bulk barns disposed in close proximity to each other by first monitoring the air flow in each respective bulk barn, and next actuating a central control unit and alarm device that serves each of the series of bulk barns.

4. The method of bulk tobacco curing and drying and monitoring air flow of claim 2 wherein the step of actuating a control unit includes actuating a relay type device associated therein that in turn switches the audible alarm device to an "on" position.

5. The method of bulk tobacco curing and drying and monitoring air flow of claim 4 wherein the step of actuating said relay type device includes the step of sensing air flow within said bulk barn such that once the air flow falls below a selected level, the air flow monitoring device is operative to open an otherwise active circuit by making the circuit nonconductive which in turn triggers the actuation of said relay device.

6. In a bulk tobacco curing and drying structure of the type having a drying enclosure, rack means disposed within said drying enclosure for supporting tobacco in bulk form therein, a forced air furnace system for generating and continuously forcing a system of air vertically through bulk tobacco contained within said drying enclosure and adding heat as necessary to maintain the temperature within the bulk tobacco barn at a selected level, the improvement comprising an air flow monitoring and alarm system for detecting inadequate air flow within said bulk barn and appraising anyone in the vicinity of the bulk barn of such, said air flow monitoring and alarm system comprising: air flow sensing means operatively associated with said bulk barn and positioned within the flow path of said system of air being circulated through the drying enclosure for sensing and detecting inadequate air flow through said bulk barn, said air flow sensing means including means responsive to flow rate for actuating the same in response to the sensed flow rate being below a predetermined level; master control means operatively connected to said air flow sensing means for switching the same between "on" and "off" states; a control unit operatively connected to said air flow sensing means and actuated thereby in response to the air flow sensing means being actuated due to air flow falling below a selected level; and an alarm device operatively associated with said control unit and responsive thereto for emitting an alarm in response to the actuation of said air flow sensing means and said control unit, such that the emission of the alarm indicates the presence of inadequate air flow.

* * * * *